United States Patent [19]

Scott

[11] 4,140,288

[45] Feb. 20, 1979

[54] METHOD FOR SPLICING PLASTIC SHEET MATERIALS

[75] Inventor: Raymond G. Scott, Oak Brook, Ill.

[73] Assignee: Champion International Corporation, Stamford, Conn.

[21] Appl. No.: 904,401

[22] Filed: May 10, 1978

[51] Int. Cl.[2] ..... B65H 19/18

[52] U.S. Cl. ..... 242/58.1; 156/157

[58] Field of Search ..... 242/58.1, 58.2, 58.3, 242/58.4, 58.5; 156/502, 504, 157, 159

[56] References Cited

U.S. PATENT DOCUMENTS

| | | | |
|---|---|---|---|
| 3,257,085 | 6/1966 | Riegger | 242/58.3 |
| 3,959,048 | 5/1976 | Stanfield et al. | 242/58.1 X |
| 4,038,121 | 7/1977 | Benson et al. | 156/507 |

*Primary Examiner*—Harvey C. Hornsby
*Assistant Examiner*—John M. Jillions
*Attorney, Agent, or Firm*—Evelyn M. Sommer

[57] ABSTRACT

To reduce the chances of breakage at splices between rolls of plastic material to be printed or otherwise treated where the rolls are to be separated after treatment for rewinding on individual cores, a length of paper material is bonded to the trailing end of each roll of plastic material. The next roll of plastic material is spliced to the paper trailer to provide the continuous length to be treated. On the delivery side of the treatment station, successive rolls of plastic material are severed at the paper trailer to reduce the chances of breakage that might otherwise occur during attempts to separate the rolls at a plastic material splice.

3 Claims, 2 Drawing Figures

METHOD FOR SPLICING PLASTIC SHEET MATERIALS

BACKGROUND OF THE INVENTION

The present invention relates to the handling of sheet materials and more particularly to a method of splicing successive rolls of plastic sheet materials to reduce the chances of breakage.

Meat and other food products are sometimes packaged in plastic wrappers or enclosures molded from plastic sheet materials such as polystyrene. In manufacturing such wrappers or enclosures, rolls of the plastic sheet material are printed with information and marketing material as the rolls are passed through rotary presses. To avoid the necessity of halting the printing operation in order to thread each roll through the printer, it is a common practice to splice the trailing edge of one roll with the leading edge of the next roll at the input side of the printer. After the plastic material is printed, the rolls are cut apart on the delivery side of the printing station and rewound on individual cores. The rewound rolls are then transported elsewhere to have individual wrappers or enclosures molded and stamped from the rolls of printed plastic material.

While the plastic materials have many advantages as packaging materials, they tend to be brittle. When rolls are separated after the printing operation by means of a cutting knife, the brittle plastic tends to shatter, wasting processed material and making it more difficult to rewind the rolls. The entire printing operation must be stopped in recovering from a break in the plastic material.

Most rotary presses have one or more drying stations which heat the printed plastic material to set the inks. When the printing operation is stopped due to a break in the plastic material, the plastic material halted within each of the drying stations is weakened by its exposure to a greater than normal amount of heat. When the printing operation is resumed, this material is more easily broken when placed under tension, compounding the problem.

SUMMARY OF THE INVENTION

The present invention is an improvement on a method of handling plastic sheet material where that sheet material is supplied to a treatment station in individual rolls, the ends of which are spliced together in order to provide a continuous length of material to be operated on in the treatment station, and where the treated material is separated on the delivery side of the treatment station into individual rolls. The improvement comprises the steps of increasing the length of each roll of plastic material by bonding a length of paper material to at least one end of the plastic material. The paper material is spliced to the contiguous roll of plastic material on the input side of the treatment station. The treated rolls are severed at the paper on the delivery side of the treatment station to minimize the chances of breakage of the relatively brittle plastic material. The length of paper may be great enough to allow the paper to occupy the entire treatment station during splicing operations, thereby eliminating overheating of plastic during splicing stops.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

DETAILED DESCRIPTION

Figure 1:
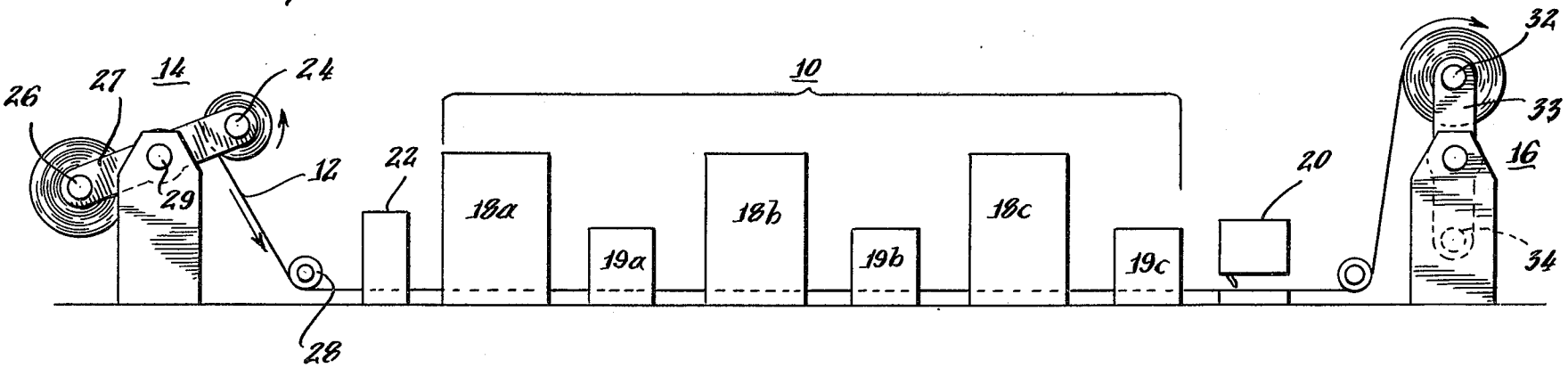
FIG. 1 is a simplified elevational view of a typical printer in which the present invention may be practiced.

Referring to FIG. 1, a printing press 10 for printing marketing material and information on a web 12 of plastic material is located between a supply station 14 and a take up station 16. The printing press 10 includes one or more printing stations, such as stations **18*a*, 18*b* and 18*c*, each of which prints the web 12 with a single color of printing ink. Each printing station is followed by a drying station 19*a*, 19*b*, 19*c* which heats the web to temperatures on the order of 175° F. to dry the applied ink before more inks are applied or before the web is rewound at the take up station. A cutting station 20 is located downstream of the press 10. A splicing station 22 is located between the supply station 14 and the press 10**.

The supply station 14 preferably includes at least two supply spindles 24 and 26 on which rolls of unprinted plastic material are mounted. During printing operations, spindles 24 and 26 are moved into an "unwind" position alternately by rotation of a common mounting bracket 27 about pivot 29. That is, plastic material is withdrawn from spindle 24 past a guide roller 28 as spindle 26 is being loaded onto bracket 27. When spindle 24 is empty or nearly empty, spindle 26 is rotated into position to begin delivery plastic material to be printed.

At the delivery side of the printing station, there are also preferably at least two take up spindles 32 and 34 on a common bracket 33. After the continuous run of plastic material has been printed and the printing ink is dried, the rolls are cut apart at cutting station 20 with successive lengths being rewound alternately on the spindles 32 and 34. That is, while spindle 32 is in use, a previously rewound roll is removed from spindle 34 to enable that spindle to begin receiving material when spindle 32 becomes fully loaded.

In accordance with the present invention, each roll of blank plastic material has a length of paperboard material bonded to at least one end, preferably the trailing edge of the plastic material. In practice the paper trailer would be spliced to the trailing edge of a plastic strip by winding several turns of paper onto a core before the plastic strip was wound onto the core. Successive rolls are bonded by lap splicing the paper trailer to the leading edge of the plastic material in the succeeding roll at the splicing station 22. After printing, the rolls are separated by cutting the paper trailer at cutting station 20.

Figure 2:
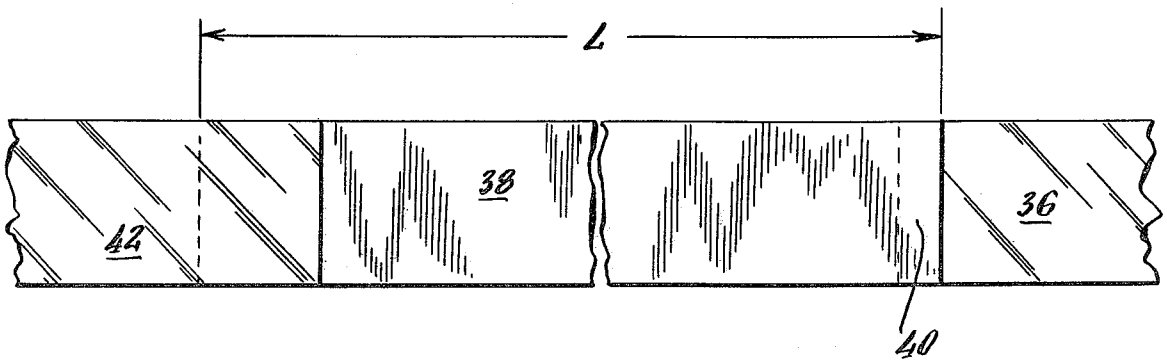
FIG. 2 is a top view of a length of plastic material with an added length of paper showing a preferred manner of splicing.

FIG. 2 shows a short length 36 of plastic material such as polystyrene to which a paper trailer 38 has been lap spliced at 40. A second length 42 is shown lap spliced to the end of paper trailer 38. The amount of paper needed for the paper trailer 38 is, to some extent, dependent upon the skill of the operator doing the splicing since the splicing is performed on the fly or while the sheet material is moving. While the length of paper may range from 10 feet to 200 feet, it is believed that 50 feet of paper may be adequate for most applications. If it can be expected that the material will be halted in the press for splicing operations, the total length L of paper may be great enough to ensure that only paper is resident within the press during planned halts for splicing operations.

While there has been described what is considered to be a preferred embodiment of the present invention, variations and modifications therein will occur to those skilled in the art once they become aware of the basic concepts of the invention. Therefore, it is intended that the appended claims shall be construed to include all such variations and modifications as fall within the true spirit and scope of the invention.

What is claimed is:

1. In method of handling plastic sheet material to be treated at a treatment station wherein plastic material is supplied to the input side of the treatment station in the form of rolls and is rewound into rolls on the delivery side of the treatment station, the improvement comprising the steps of increasing the length of each supplied roll by bonding a length of paper material to at least one end of each roll, splicing the paper material of one roll to material of a contiguous roll at the input side of the treatment station to form a contiguous length of material for treatment and severing contiguous rolls at the delivery side of the treatment station only at the regions of paper material to minimize breakage of the plastic material.

2. A method as recited in claim 1 wherein the length of paper material is added to the trailing end of each roll and is spliced to the plastic material at the leading edge of the next roll at the input side of the treatment station.

3. A method as recited in claim 2 wherein the paper material is lap spliced to the plastic material of the next roll.

* * * * *